US005293706A

United States Patent [19]

Wood

[11] Patent Number: 5,293,706

[45] Date of Patent: Mar. 15, 1994

[54] MULTIPLE-IMAGE DISPLAY DEVICE

[76] Inventor: Cliff Wood, Bob Hill Rd., Pound Ridge, N.Y. 10576

[21] Appl. No.: 985,318

[22] Filed: Dec. 4, 1992

[51] Int. Cl.[5] ..... G09F 1/00

[52] U.S. Cl. ..... 40/124.1; 40/445; 446/148; 472/63

[58] Field of Search ..... 40/124.1, 219, 900, 40/445; 283/117; 446/148, 149; 472/63

[56] References Cited

U.S. PATENT DOCUMENTS

| | | | |
|---|---|---|---|
| 1,329,078 | 1/1920 | Furstenberg | 40/486 X |
| 1,346,017 | 7/1920 | Goodman | 446/147 |
| 4,313,270 | 2/1982 | Volkert et al. | 40/124.1 |
| 4,989,355 | 2/1991 | Thomas | 40/124.1 X |

*Primary Examiner*—Brian K. Green

*Attorney, Agent, or Firm*—Cohen, Pontani Lieberman, Pavane

[57] ABSTRACT

A folded card-like promotional display device includes first and second panels pivotally movable between a first, closed condition of the device and a second, relatively open condition, and a third panel located between and depending from one of the first and second panels. A first image carried on a first face of the third panel is viewable in the closed condition of the device through a window defined in the first panel. A second image carried on a second, opposite face of the third panel is viewable only in the second, open condition of the device in which both the second image and a reflected image of the first image—the reflected image being seen in a reflective surface carried on the inner face of the first panel—are concurrently viewable. The second image is not viewable through the window or otherwise in the first condition of the device.

25 Claims, 2 Drawing Sheets

FIG. 3
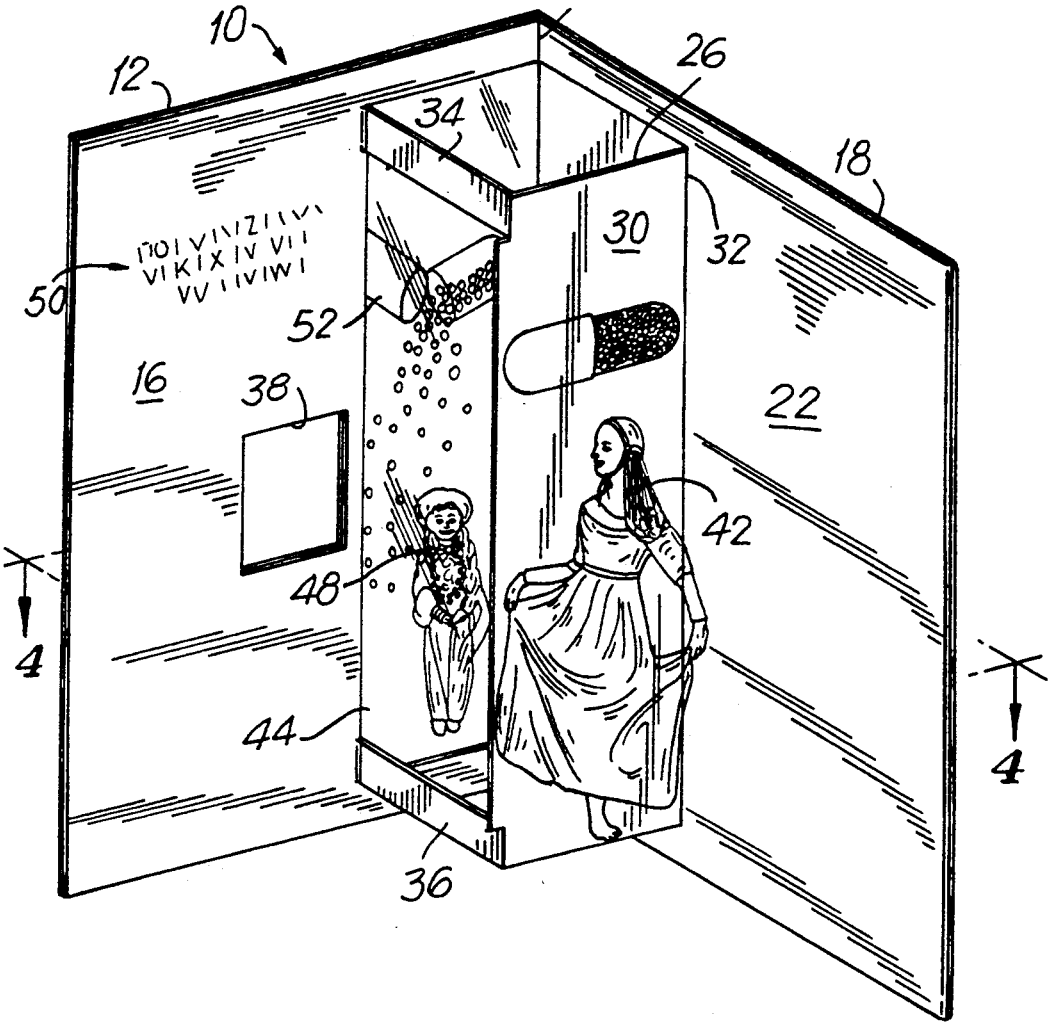
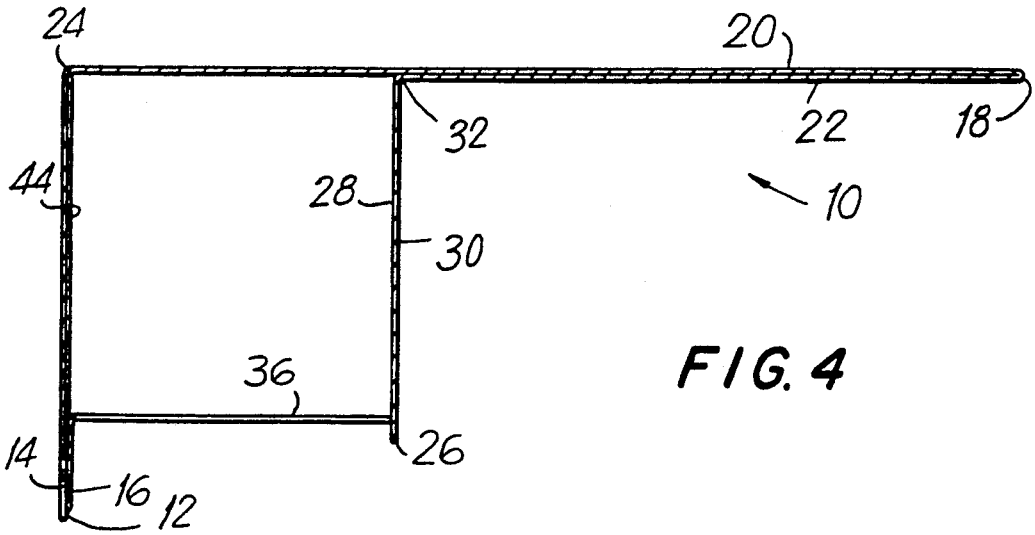
FIG. 4

MULTIPLE-IMAGE DISPLAY DEVICE

FIELD OF THE INVENTION

The present invention is generally directed to display devices and, more particularly, to promotional displays having multiple viewable and, typically, related images.

OBJECTS OF THE INVENTION

It is the desideratum of the invention to provide a display device useful in the advertising or promotion of articles or services and enabling observer viewing of a plurality of images in a predetermined sequence and/or combination as a function of a changeable condition of the display device and/or of the observer's relative position or viewing angle vis-a-vis the device.

It is a particular object of the invention to provide such a display device that is movable between a first condition in which only a first image is viewable and a second condition in which a combination of the first and of a second image is viewable.

It is another object of the invention to provide such a display device which may be hand-held by an observer for selective, manually-effected manipulation between its first and second conditions.

A further object of the invention is to provide such a display device that may be easily fabricated of inexpensive and readily-available materials.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements throughout the several views:

FIG. 3 is an elevated perspective view of the display device of FIG. 1 shown in a second, relatively open condition of the device; and FIG. 4 is a cross-sectional view, partially broken away, taken along the lines 4—4 in FIG. 3.

DETAILED DESCRIPTION OF THE PREFERRED EMBODIMENTS

In its broadest sense, the present invention is directed to a display device useful, by way of example, in the advertising or promotion of articles or services and enabling observer viewing of a plurality of images in a predetermined sequence and/or combination as a function of a changeable condition of the display device and/or of the observer's relative position or viewing angle vis-a-vis the device. Described herein, and shown in the accompanying drawings, is a currently-preferred embodiment of the invention, in the form of a hand-held, folded card-like device that is manually and selectively-changeable between a first, substantially closed condition in which only a first image of the card is viewable and a second, generally open condition in which both the first image and a second image of the card are concurrently viewable by a holder or observer of the device. It is generally anticipated, in such an embodiment, that the first and second images will have some common theme or meaning or relationship so that, when the images are viewed concurrently in the second condition of the device, they may together impart a suitable or intended message or connotation to the viewer. Other and variously modified forms of a display device constructed in accordance with the invention are also contemplated, as should become apparent as this description proceeds.

Figure 1:
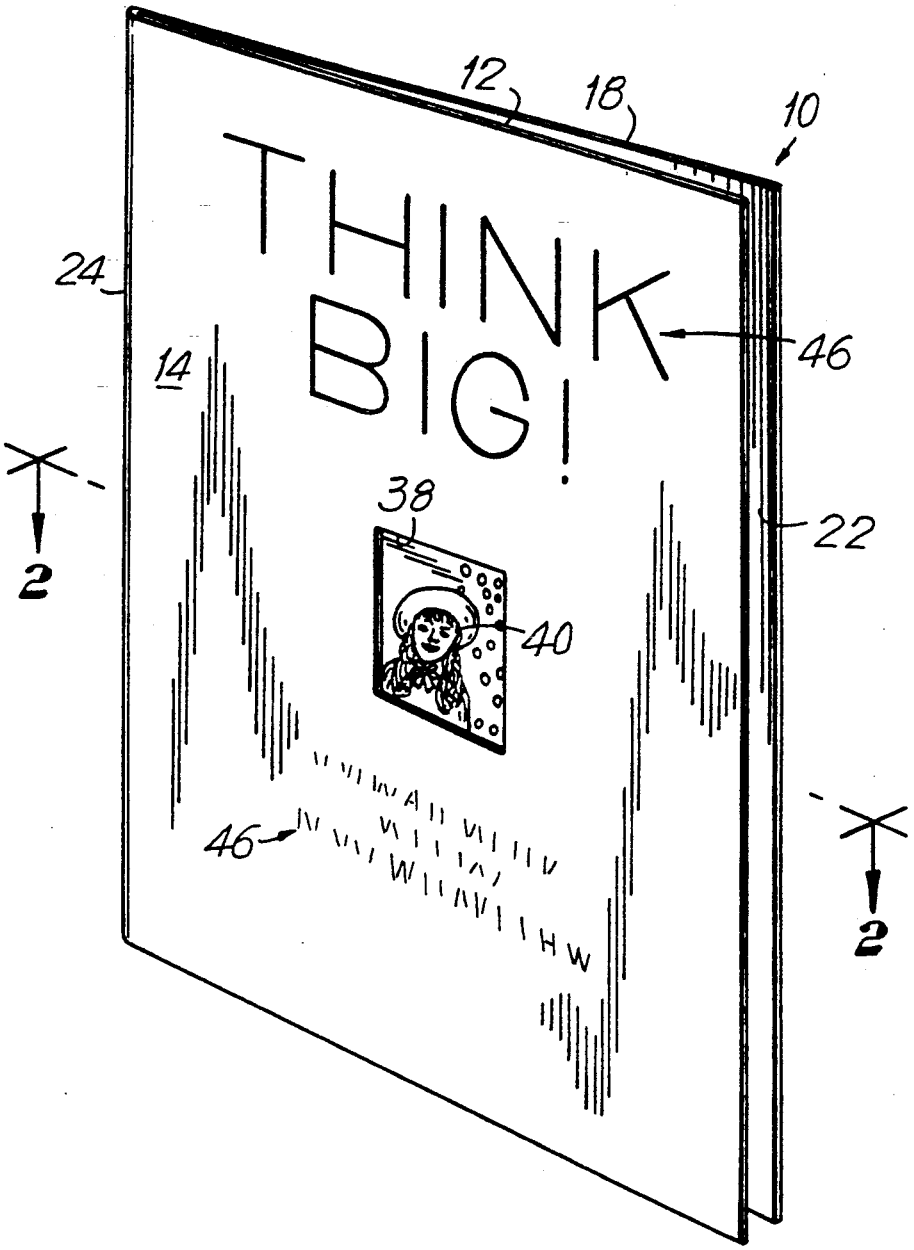
FIG. 1 is an elevated, front perspective view of a display device constructed in accordance with the teachings of the present invention and seen in a first, relatively closed condition of the device.

With particular reference now to the drawings, there is shown a display device constructed in accordance with the teachings of the present invention and implemented in the specific form of a hand-held, user-manipulatable promotional card 10. The card 10 includes a first panel 12 having a front or outer face 14 and an inner face 16 on opposite sides of the substantially flat panel 12, and a second panel 18 having a rear or outer face 20 and an inner face 22 on opposite sides of the substantially flat panel 18. The first and second panels are integrally joined or connected at a respective edge of each to form a joint 24 about which the panels are relatively pivotable between a first or closed condition of the card 10, as depicted in FIG. 1, and a second or generally open condition illustrated in FIG. 3. In the illustrated card 10, and as is generally preferred, the first and second panels are of substantially the same size and dimensional extent so as to coextensively overlap in the first condition of the card.

It is generally intended that the card 10 be advantageously capable, in its first condition, of being fully closed so as to maximally flatten the card through substantial abutment of at least portions of the inner faces 16, 22 of the panels 12, 18. It is further contemplated that the card 10 may optionally be provided with a strap or the like (not shown) spanningly connecting the panels 16, 22, or with another functionally equivalent arrangement, for limiting the relative pivotal opening movement of the first and second panels about the joint 24 and thereby predeterminately delineating the maximum angular separation of the two panels in the second condition of the card. In any event, in a currently-preferred relationship of the first and second panels in the second condition of the herein-disclosed card 10, the inner surfaces 16, 22 of the panels 12, 18 are separated by an angle of approximately 90-degrees—although the preferred angle may significantly vary therefrom as general matters of design choice and of the intended operative functionality and/or utility of the inventive display device. In this open or second condition of the card 10, the panels 12, 18 define an interior space therebetween and bounded by their respective inner surfaces 16, 22.

The card 10 further includes a substantially flat third panel 26 disposed in the interior space between and in predetermined orientation to the first and second panels. The third panel has a first face 28 disposed in confronting opposition to the first panel inner face 16, and a second face 30 opposite the third panel first face 28 and disposed in confronting opposition to the second panel inner face 22. The third panel 26 is integrally joined, along one edge, to the inner face 22 of the second panel 18 at an offset spacing from the joint 24 for pivotal movement of the third panel 26 relative to the second panel 18 about the joinder line 32 and, along its opposite edge, is connected to the first panel inner face 16 by upper and lower arms 34, 36 which spanningly join the third panel to the first panel inner face. The arms 34, 36 are preferably dimensioned so as to maintain the third panel in a predeterminately-fixed relation to the first panel as the first and second panels 12, 18 are pivoted between the first and second conditions of the card 10. In the illustrated embodiment of the inventive display device, the arms 34, 36 are preferably of substantially equal length and are sized to maintain the third panel in substantially parallel relation to the first panel 12 or, more particularly, to the first panel inner face 16.

A substantially transparent window 38 defined in the first panel 12 permits a user or viewer of the card 10 to look or peer into the card interior through the window. Thus, an observer located proximate the outer face 14 of the first panel may look through the window 38 to view at least a predetermined portion of the interior of the card. In the illustrated embodiment of the invention, the window consists of a generally rectangular opening or cutout in and through the first panel 12, although the window may optionally assume other forms so long as it provides substantial transparency or viewability into the card interior from the exterior front face thereof.

On its first face 28, the third panel carries a first image 40 positioned so that, in the first or closed condition of the card 10, at least a portion of the first image is viewable through the window 38. A second image 42 is carried on at least one of the third panel second face 30 and the second panel inner face 22; in the illustrated card 10, various portions of the second image can be seen as being carried on each. As should be apparent, the position of the second image 42 is such that the second image cannot be seen through the window 38 in the first condition of the card 10; this limitation is notably preferred although embodiments in which a predetermined or limited portion of the second image can be seen through the first panel window in the first condition of the card are also within the intended scope of the invention. Finally, a mirror-like reflective surface or member 44—implemented, by way of example, as a thin film or sheet of reflective Mylar material—is carried on the inner face 16 of the first panel 12. In the herein-disclosed display card 10, the reflective surface 44 is carried on the first panel inner face in confronting opposition to the third panel first face 28 on which the first image 40 is carried.

The generally-contemplated utility and functionality of the multiple-image promotional display card 10 will now be described. In the first or closed condition of the card as seen in FIG. 1, at least a portion of the first image 40—and only the first image—is viewable through the window 38; that is, the second image 42 cannot be seen through the window 38 in the closed condition of the card 10. The front face 14 of the first panel 12 may also optionally bear appropriate text 46 and/or additional illustrations or images to provide a holder or viewer or observer of the card 10 with an intended message related to the promotional objective of the card and to the substance of the viewable first image 40.

The user then manipulates one or both of the first and second panels 12, 18 to relatively pivot the same about the joint 24 and thereby move the panels to the second or open condition of the card 10 that is shown in FIG. 3. As the first and second panels are thus relatively pivoted about the edge joint 24, the third panel 26 is concurrently pivoted about its joinder 32 to the second panel inner face 22 such that the third panel remains substantially parallel (in the illustrated embodiment) to the first panel 12. In the open condition of the card 10, a holder or user of the card, looking into the interior space defined between the first and second panels 12, 18, concurrently sees both the second image 42—which is carried on at least one of the third panel second face 30 and the first panel inner face 22—and a reflection 48, in the reflective surface 44, of the first image 40 from the third panel first surface 28. The viewer or user may thereby be imparted with a predetermined theme or message derived from the relationship between the first and second images 40, 42 and, if desired, from optional additional text 50 and/or illustrations or images viewable only in the second, open condition of the card 10. Such additional images may also take the form of one or more portions of the first image 40 that cannot be seen through the dimensionally-limited window 38 in the first, closed condition of the card but that are viewable in the second, open condition of the inventive display card 10, or of further images on the third panel first surface 28 that are positionally-associated with the first image 40 and are thereby viewable as a part of the reflected image 48, as for example indicated at 52 in FIG. 3.

Figure 2:
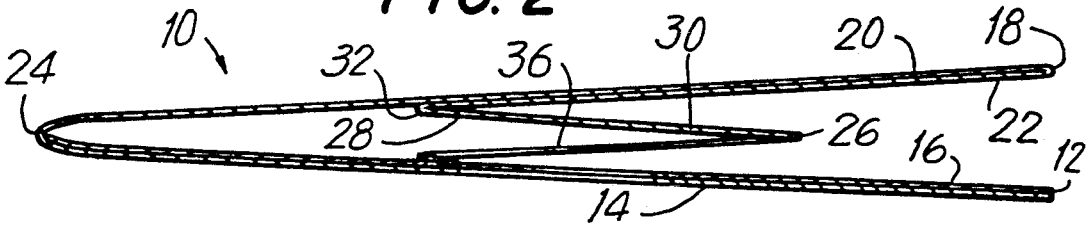
FIG. 2 is a cross-sectional view, partially broken away, taken along the lines 2—2 in FIG. 1.

Fabrication of the promotional card 10 may be carried out in any of numerous ways that will readily suggest themselves to those skilled in the art. A currently-preferred procedure forms the card 10 of only two elements—a single blank of a preferably medium-to-heavy weight paperboard stock or cardboard substrate, and a short, elongated strip of Mylar film material (to provide the reflective surface 44). As should be apparent from the drawings (see particularly FIGS. 2 and 4), a single elongated, substantially rectangular paper blank is folded overlappingly in half to form the primarily double-thickness first and second panels 12, 18, and is then folded in half once again to define the pivotal edge joint 24 between the panels. The third panel 26 and arms 34, 36 are formed by cutting them from a portion of the overlapping blank so that the first, second and third panels are fabricated as unitarily integral portions of the card 10. The formation of the third panel and arms—including scoring to define the necessary fold lines between the third panel and arms, and between those elements and the first and second panels—is preferably effected in the initial fabrication of the blank so that as the first, overlapping fold is made, the overlapped halves of the blank may concurrently be glued or otherwise affixed one to the other in surface-to-surface abutment to form the so-rigidified first and second panels 12, 18. Finally, the Mylar film strip is affixed, as with a suitable adhesive or the like, to the inner surface 16 of the first panel 12 to provide the reflective surface 44. This preferred fabrication procedure is, nevertheless, only one of many and all such variations are within the intended scope and contemplation of the invention.

Other and modified forms of multiple-image displays constructed in accordance with the broad concept and teachings of the present invention are also contemplated. For example, an enlarged, free-standing display device having the general form of the herein-shown and described promotional card 10 may be arranged such that the first, second and third panels are disposed in a positionally-fixed relationship substantially corresponding to the second or open condition of the card 10 illustrated in FIG. 3. In such an embodiment, it is intended that the viewer or observer will walk or otherwise move around at least a portion of the periphery of the positionally-fixed display device, starting proximate the front or outer face of the first panel for viewing of the first image through the first panel window and then proceeding to a position adjacent or proximate the interior space defined between the first and second panels at which the viewer will concurrently see the second image and the first image reflection. Such an arrangement may also merit or require positional relocation of the window 38 and/or reflective surface 44 and, to the extent that the relocated position(s) of the window and reflective surface overlap, the reflective surface may be implemented as a half-silvered or one-way mirror or reflective member that is substantially transparent as an observer looks inwardly through the window from the first panel front surface but is at least predominantly reflective when viewed from the opposite direction. These and numerous other modifications in the form and/or operation of display devices constructed in accordance with the present invention will readily suggest themselves to those ordinarily skilled in the art and having knowledge of this disclosure and teachings.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. It is the intention, therefore, to be limited only as indicated by the scope of the claims appended hereto.

What is claimed is:

1. A multiple-image display device viewable by an observer, comprising:

a first panel having a substantially transparent window defined therethrough and a second panel connected to said first panel, one of said panels being movable relative to the other of said panels between a first position of substantial proximity of portions of said panels and a second position of relative spacing between said portions of said panels and defining an interior space between said panels;

a third panel disposed between said first and second panels;

attachment means connecting said third panel to at least one of said first and second panels for predetermined movement of said third panel relative to said first and second panels as said first and second panels are relatively moved between said first and second positions such that said third panel is maintained in a substantially fixed orientation to said first panel throughout said predetermined movement of said third panel;

a first image disposed between said first and second panels and viewable through said window in said first portion of the panels;

a second image disposed between said first and second panels so that said second image cannot be viewed through said window in said first position of the panels; and means disposed between said first and second panels for reflecting an image of said first image in said second position of the panels so that the second image and the reflected image of said first image are concurrently viewable in said interior space in said second position of the panels.

2. A multiple-image display device in accordance with claim 1, wherein said window comprises an opening defined in and through said first panel.

3. A multiple-image display device in accordance with claim 1, wherein said first image is carried on a first face of said third panel in confronting opposition to said first panel.

4. A multiple-image display device in accordance with claim 3, wherein said reflecting means is carried on an inner face of said first panel in confronting opposition to said first face of said third panel.

5. A multiple-image display device in accordance with claim 4, wherein said reflecting means comprises a mirror.

6. A multiple-image display device in accordance with claim 4, wherein said second image is carried on at least one of a second face of said third panel opposite said third panel first face and an inner face of said second panel in confronting opposition to said third panel second face.

7. A multiple-image display device in accordance with claim 1, wherein each of said first and second panels have an edge along which said first and second panels are pivotally connected for relative pivotal movement of said first and second panels about said connected edges between said first and second positions.

8. A multiple-image display device in accordance with claim 7, wherein said attachment means comprises a first edge on said third panel and along which said third panel is pivotally connected to an inner face of said second panel.

9. A multiple-image display device in accordance with claim 8, wherein said attachment means further comprises a second edge on said third panel opposite said third panel first edge and connected to an inner face of said first panel disposed in confronting opposition to a first face of said third panel.

10. A multiple-image display device in accordance with claim 9, said attachment means further comprising an arm spanningly connecting said third panel second edge to said first panel inner face.

11. A multiple-image display device in accordance with claim 10, wherein said arm is dimensioned for maintaining said third panel in substantially parallel relation to said first panel as said first and second panels are moved between said first and second positions.

12. A multiple-image display device viewable by an observer, comprising:

a first panel having an outer face, an inner face opposite said outer face, and a substantially transparent window defined through said first panel;

a second panel having an inner face and an outer face opposite said second panel inner face, said first and second panels being connected together and relatively disposed so as to define an interior space between said first and second panels and bounded by at least a portion of said first panel inner face and at least a portion of said second panel inner face;

a third panel disposed between and connected to at least one of said first and second panels and having a first face disposed in confronting opposition to said first panel inner face and a second face opposite said third panel first face and disposed in confronting opposition to said second panel inner face;

a first image carried on said third panel first face, said first image and said window being predeterminately located so that said first image is viewable through said window by an observer situated proximate said first panel outer face;

a second image carried on said third panel second face so that said second image cannot be viewed through said window by an observer situated proximate said first panel outer face; and means disposed in said interior space between said first and second panels for reflecting an image of said first image in said second image and the reflected image of said first image are concurrently viewable by an observer situated proximate said interior space.

13. A multiple-image display device in accordance with claim 12, wherein said window comprises an opening defined in and through said first panel.

14. A multiple-image display device in accordance with claim 12, wherein said reflecting means is carried on said first panel inner face.

15. A multiple-image display device in accordance with claim 12, wherein each of said first and second panels have an edge along which said first and second panels are connected.

16. A multiple-image display device in accordance with claim 15, wherein said third panel has an edge along which said third panel is connected to said second panel inner face.

17. A multiple-image display device in accordance with claim 12, wherein said first and second faces of said third panel are disposed in a predeterminately fixed orientation relative to said first panel inner face.

18. A multiple-image display device in accordance with claim 12, wherein said third panel is disposed in a predeterminately fixed orientation relative to said first panel.

19. A multiple-image display device viewable by an observer, comprising:

a first panel having a substantially transparent window defined therethrough and a second panel, one of said first panels being movable relative to the other of said panels between a first position of substantial proximity of portions of said panels and a second position of relative spacing between said portions of said panels and defining an inner space between said panels, and each of said first and second panels having an edge along which said first and second panels are pivotally connected for relative pivotal movement of said first and second panels about said connected edges between said first and second positions;

a third panel disposed between said first and second panels and having a first edge along which said third panel is pivotally connected to an inner face of said second panel, said third panel having a second edge opposite said third panel first edge and connected to an inner face of said first panel disposed in confronting opposition to a first face of said third panel;

a first image disposed between said first and second panels and viewable through said window in said first position of the panels;

a second image disposed between said first and second panels so that said second image cannot be viewed through said window in said first position of the panels; and means disposed between said first and second panels for reflecting an image of said first image in said second position of the panels so that the second image and the reflected image of said first image are concurrently viewable in said interior space in said second position of the panels.

20. A multiple-image display device in accordance with claim 19, further comprising an arm spanningly connecting said third panel second edge to said first panel inner face.

21. A multiple-image display device in accordance with claim 20, wherein said arm is dimensioned for maintaining said third pane in substantially parallel relation to said first panel as said first and second panels are moved between said first and second positions.

22. A multiple-image display device in accordance with claim 19, wherein said first image is carried on a first face of said third panel in confronting opposition to said first panel.

23. A multiple-image display device in accordance with claim 22, wherein said reflecting means is carried on an inner face of said first panel in confronting opposition to said first face of said third panel.

24. A multiple-image display device in accordance with claim 23, wherein said second image is carried on at least of a second face of said third panel opposite said third panel first face and an inner face of said second panel in confronting opposition to said third panel second face.

25. A multiple-image display device in accordance with claim 24, wherein said third panel is disposed in a fixed orientation relative to one of said first and second panels.

* * * * *

UNITED STATES PATENT AND TRADEMARK OFFICE

CERTIFICATE OF CORRECTION

PATENT NO. : 5,293,706

DATED : March 15, 1994

INVENTOR(S) : Cliff Wood

It is certified that error appears in the above-identified patent and that said Letters Patent is hereby corrected as shown below:

In claim 19, line 5, after "of said" delete "first".

Signed and Sealed this

Nineteenth Day of March, 1996

*Attest:*

*Attesting Officer*

BRUCE LEHMAN

*Commissioner of Patents and Trademarks*